US005626269A

United States Patent [19]

Duarte

[11] Patent Number: 5,626,269

[45] Date of Patent: May 6, 1997

[54] DEVICE FOR DONNING SOCKS ON A USER

[76] Inventor: Jose Duarte, 8000 W. 16th Ave., Hialeah, Fla. 33014

[21] Appl. No.: 567,657

[22] Filed: Dec. 5, 1995

[51] Int. Cl.[6] ..... A47G 25/90

[52] U.S. Cl. ..... 223/112

[58] Field of Search ..... 223/111, 112, 223/113, 115

[56] References Cited

U.S. PATENT DOCUMENTS

| | | | |
|---|---|---|---|
| 2,443,115 | 6/1948 | Park | 223/111 |
| 2,894,669 | 7/1959 | Silken | 223/111 |
| 2,919,840 | 1/1960 | Hoagland . | |
| 3,883,052 | 5/1975 | Wilson | 223/111 |
| 4,072,255 | 2/1978 | Bogorad | 223/111 |
| 4,130,226 | 12/1978 | Farrell | 223/111 |
| 5,050,783 | 9/1991 | Hunter | 223/112 |

FOREIGN PATENT DOCUMENTS 1079238 6/1980 Canada .

*Primary Examiner*—Bibhu Mohanty
*Attorney, Agent, or Firm*—J. Sanchelima

[57] ABSTRACT

A device to help a user to put on a sock that includes an assembly that holds a sock from its opening in distension to permit a user to insert his or her foot through. A pair of hingedly mounted telescopic arm members with a handle on each end that allows a user to pull the sock up. A clamping assembly to firmly grab the sock while a user pulls and the clamping assembly is mounted to the extension arms so that a user can readily actuate it and disengage the sock after it is in place.

5 Claims, 2 Drawing Sheets

DEVICE FOR DONNING SOCKS ON A USER

BACKGROUND OF THE INVENTION

1. Field of the Invention

The present invention relates to a device that aids a user in putting his or her socks on.

2. Description of the Related Art

Applicant believes that the closest reference corresponds to U.S. Pat. No. 2,919,840 issued to L. M. Hoagland. However, it differs from the present invention because it still requires a user to bend down to disengage clamping slide 18. Similarly, the disclosure of Canadian patent No. 1,079,238 issued to Jacobucci in 1978, provides for a "bulldog clip" that also requires a user to bend down to disengage thereby also defeating one of the main objectives of this invention.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a device that helps a user to don his or her socks on with minimum bending of her or his back. The present invention acts as an extension of the user's arms.

It is another object of this invention to provide a device that is collapsible and volumetrically efficient to transport and store.

It is still another object of the present invention to provide a device that has such a structure that permits a user to readily don a sock with a minimum of effort.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 1 illustrates the present invention with a sock mounted thereon, corresponding to the first step in the process of putting it on.

DETAILED DESCRIPTION OF THE PREFERRED EMBODIMENT

Figure 1:
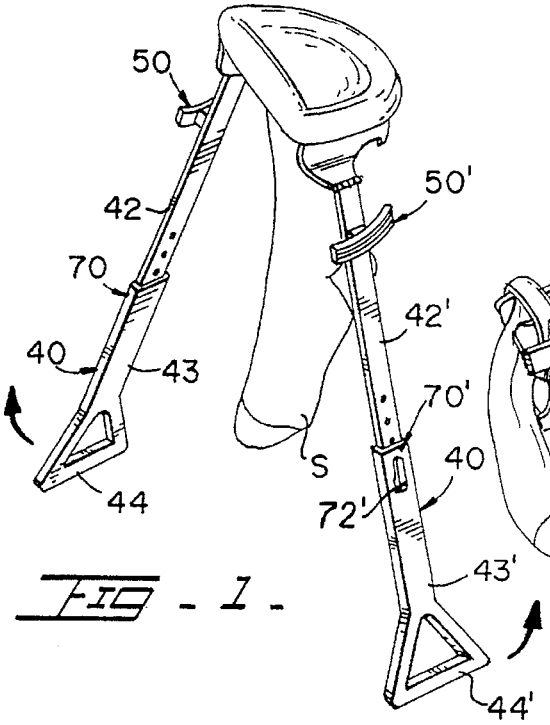

Referring now to the drawings, where the present invention is generally referred to with numeral 10, it can be observed that it basically includes sock holding assembly 20, extension arm assembly 40 and clamping assemblies 50 and 50'.

Figure 5:
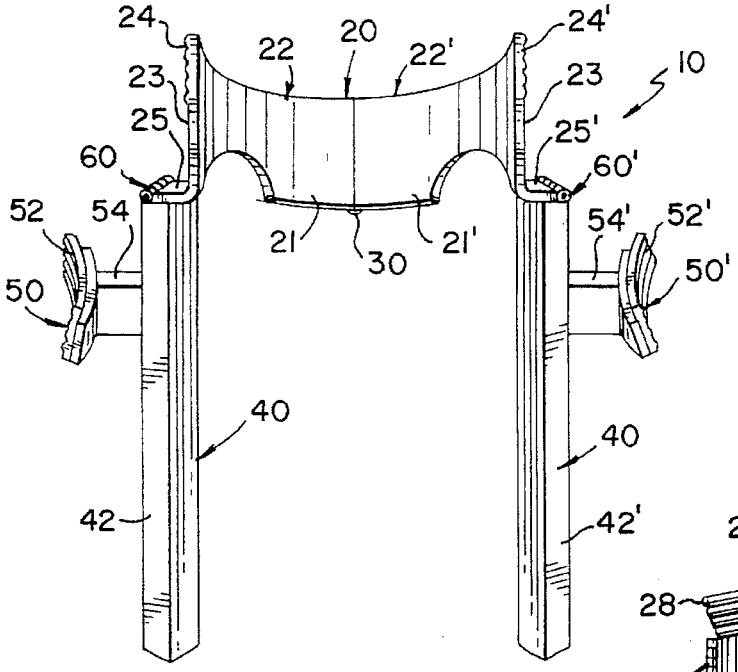
FIG. 5 is a partial elevational front view of one end of the present invention, showing the sock holding assembly.

As shown in FIGS. 1 and 5, a user places device 10 preferably between his or her legs while is mounting the ribbed top of sock S over sock holding assembly 20. Handle members 44 and 44' rest on the ground thereby bringing more stability in this first step. FIG. 5 illustrates the first step for this invention.

Figure 7:
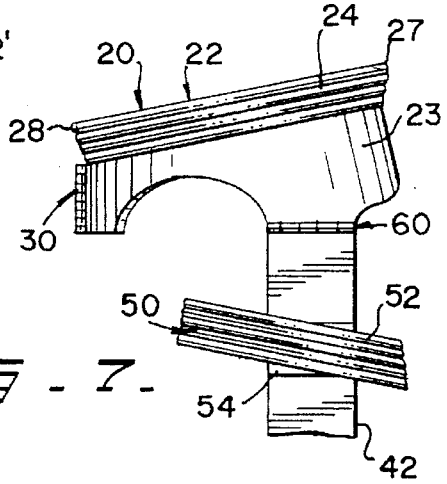
FIG. 7 is an elevational side view of the present invention, previously shown in FIGS. 5 and 6.
Figure 6:
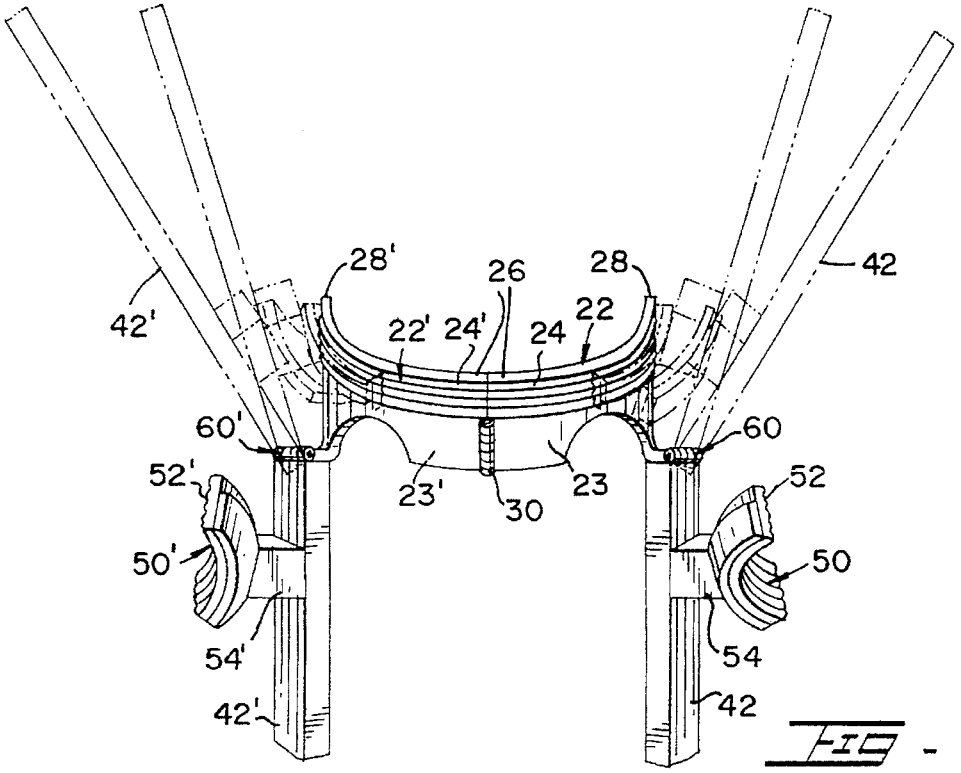
FIG. 6 is a partial elevational rear view of this invention showing the movement of the extension assembly for the functionality of the preferred embodiment, subject of the present invention.

Sock holding assembly 20, as best seen in FIGS. 5 and 6, includes curved bands 22 and 22' joined to each other with hinge assembly 30. Curved bands 22 and 22' form a C-shaped configuration with inner surfaces 21 and 21' and outer surfaces 23 and 23'. Sock S is placed adjacent to inner surfaces 21 and 21'. Outer surfaces 23 and 23' preferably have uneven or rugged surfaces 24 and 24', respectively, located at the uppermost portions of curved band members 22 and 22'. Uneven or rugged surfaces 24 and 24' are designed to enhance the gripping of sock S, as best seen in FIGS. 6 and 7. Also, slight outwardly extensions 27; 28 and 28' of curved bands 22 and 22', respectively, further ensures that sock S stays in place, as best seen in FIGS. 6 and 7. Outward extensions 27; 28 and 28' cannot be too pronounced since it may obstruct the release of sock S after being donned, but protruded enough to hold sock S even without clamping assemblies 50 and 50'.

Hinge assembly 30, in the preferred embodiment, allows users with legs of different dimensions to use the present invention. Hinge assembly 30 permits curved bands 22 and 22' to be separated with respect to each other while a user is inserting his or her foot inside sock S thereby avoiding obstruction. In this manner, a user adjusts the size of the opening of sock S.

Curved band members 22 and 22' of assembly 20 are also hingedly mounted to extension arm assembly 40 by hinge assemblies 60 and 60', respectively, as shown in FIGS. 5; 6 and 7. Extension arm assembly 40, in the preferred embodiment, includes arm members 42 and 42' telescopically mounted to arm members 43 and 43'. The overall length of arm members 42; 42' and arm members 43; 43' is adjusted with latching mechanisms 70 and 70', as best seen in FIGS. 1 through 4. Adjusting latching mechanisms 70 and 70' are designed to readily adjust to a desire length of extension assembly 40, in accordance with a user's needs (size and handicap difficulties). Adjusting latching mechanisms 70 and 70' include latching pin members 72 and 72' mounted to the outer surface of members 43 and 43', respectively. Latching pin members 72 and 72' pass one of the several openings located in members 42 and 42' in accordance with the desired length for extension arm assembly 40. Arm members 42 and 42' are hingedly mounted to flange 25 and 25', respectively, by hinge assembly 60 and 60'. Flanges 25 and 25' extend outwardly from the ends of curved band members 22 and 22'. As shown in FIGS. 1 through 4, arm members 43 and 43' have, at their distal ends, handle members 44 and 44'. Handle members 44 and 44' facilitate a user to easily manipulate device 10.

Arm members 42 and 42', in the preferred embodiment, also include clamping assemblies 50 and 50' rigidly mounted thereon. Clamping assemblies 50 and 50', have clamping members 52 and 52' rigidly mounted to spacer members 54 and 54', respectively, which in turn are mounted to arms 42 and 42'. Clamping members 52 and 52', as best seen in FIGS. 5; 6 and 7, preferably include a rugged material with high functional or gripping characteristics similar to cooperating rugged surfaces 24 and 24' of sock holding assembly 20.

Figure 2:
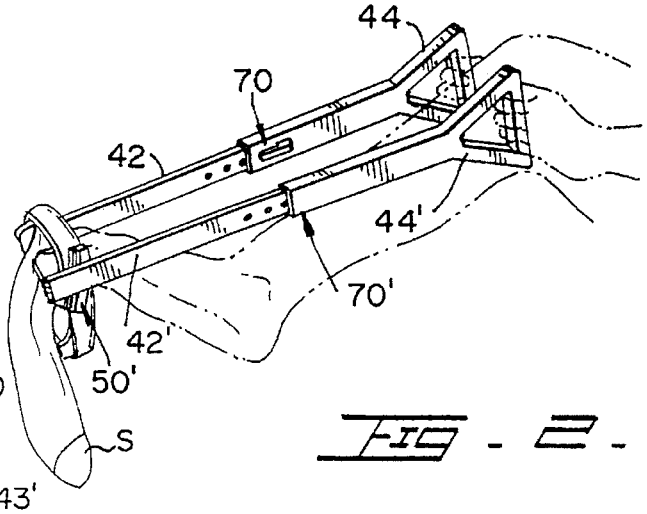
FIG. 2 illustrates a user inserting his foot inside the sock as the second step.
Figure 3:
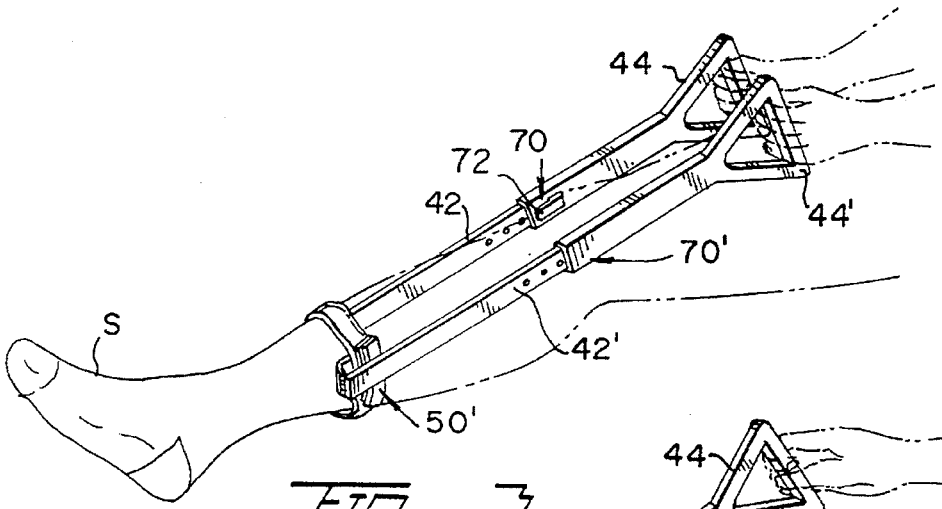
FIG. 3 illustrates a user pulling the sock up, corresponding to the third step.
Figure 4:
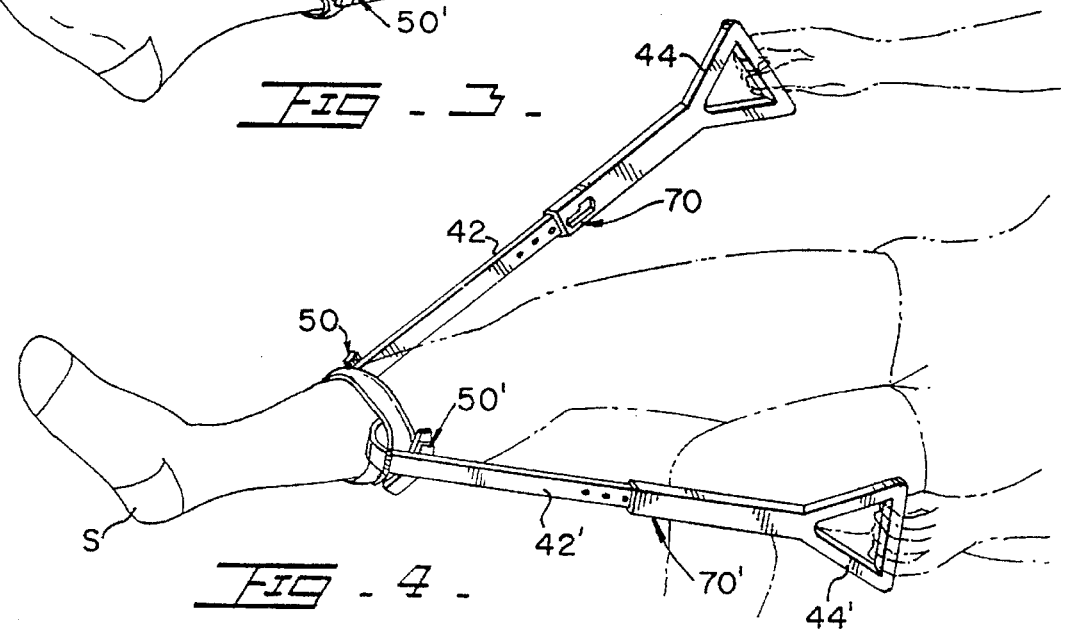
FIG. 4 illustrates a user disengaging the sock holding assembly holding the sock, corresponding to the fourth and last step.

After sock S is mounted over upper edge 26 of curved bands 22 and 22', a user pivots arms 42 and 42' (arms 43 and 43') in the direction shown by the arrows in FIG. 1. FIG. 2 illustrates the second step for this invention. Handle members 44 and 44' are now approximately 180 degrees with respect to where they were in FIG. 1. In this manner, clapping members 52 and 52' trap part of the ribbed top of sock S against rugged surfaces 24 and 24'. At this point, a user inserts his or her foot inside the opening of sock S, pulling extension arm assembly 40 from handle members 44 and 44'. In FIG. 3, a user finishes donning sock S on. Then, arms 42 and 42' (arms 43 and 43') are pivoted away from each other releasing clamping members 52 and 52', as best seen in FIG. 4. After that, device 10 is ready to be removed by pushing it down along a user's leg towards his or her foot.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A device to aid a user in donning a sock having a top opening onto his or her foot, said device comprising:

a semi-circular adjustable means for holding the top opening of the sock in an expanded position to allow the user to insert his or her foot into the sock;

an extension arm assembly mounted by a hinge on each of two opposing sides of the adjustable means for allowing the device to be pulled along the user's leg;

and a clamping means mounted to each extension arm assembly to hold the sock between the adjustable means and the respective extension arm assembly for gripping the sock therebetween;

wherein the sock may be placed over the adjustable means, clamped between the clamping means and the adjustable means, and pulled upward onto a user's legs using the extension arm assembly.

2. The device set forth in claim 1 wherein said adjustable means for holding said sock includes two curved bands hingedly mounted to each other and said sock is positioned thereon.

3. The device set forth in claim 2 wherein said clamping means are mounted to said extension arm means so that said clamping means are actuated by said extension arm assembly.

4. The device set forth in claim 3 wherein said extension arm assembly includes two telescopically extending arm members.

5. The device set forth in claim 4 wherein said arm members include each handle means.

* * * * *